United States Patent [19]

Maisel

[11] 4,386,507

[45] Jun. 7, 1983

[54] WING CAM GUIDE FOR KNITTING MACHINE LOCKS

[76] Inventor: Hans Maisel, Timesstrasse 5, D-8581 Mistelbach, Fed. Rep. of Germany

[21] Appl. No.: 167,562

[22] Filed: Jul. 11, 1980

[30] Foreign Application Priority Data

Jul. 12, 1979 [DE] Fed. Rep. of Germany ..... 2928257

[51] Int. Cl.[3] ..... D04B 7/00; D04B 9/00

[52] U.S. Cl. ..... 66/78; 66/57

[58] Field of Search ..... 66/78, 57, 47, 48

[56] References Cited

U.S. PATENT DOCUMENTS

| | | | |
|---|---|---|---|
| 162,886 | 5/1875 | Bickford | 66/57 |
| 579,199 | 3/1897 | Wakeman | 66/78 |
| 1,388,781 | 8/1921 | Stibbe | 66/22 |
| 3,030,785 | 4/1962 | Lunak | 66/57 X |
| 3,158,012 | 11/1964 | Kahan | 66/31 |
| 3,387,466 | 6/1968 | Beckenstein | 66/38 |
| 3,405,542 | 10/1968 | Beckenstein | 66/38 |
| 3,520,153 | 7/1970 | Rothe | 66/57 |
| 3,791,173 | 2/1974 | Furr | 66/57 |
| 4,080,807 | 3/1978 | Maisel . | |

*Primary Examiner*—Ronald Feldbaum

*Attorney, Agent, or Firm*—Allison C. Collard; Thomas M. Galgano

[57] ABSTRACT

A wing cam guide for knitting machine locks and, in particular, those used for knitting machines having arcuate needles, needle beds and needle guides, includes a wing cam mounted on a pivot axis.

7 Claims, 4 Drawing Figures

A-B
C-D
E-F

WING CAM GUIDE FOR KNITTING MACHINE LOCKS

The present invention relates to a wing cam guide for knitting machine locks.

Such a locking or breech part which is also called a trigger part serves to move needles from the locking or catch position into the release or knocking-over position and is adjustable in a straight line by about 50° by a longitudinal opening or slot which runs beneath the longitudinal axis of the lock for providing firmness or tightness to the knitted material. Control means are provided so as to place one wing cam, which does not contribute to the mesh forming in the one movement direction of the lock, into an inactive position, so that the needle bases, butts or feet may run without interference through the guide channel formed by the remaining lock portions. This common type of linear groove guidance for adjusting the wing cam is very sensitive to dirt or other pollution and is sensitive to wear which results in jamming. As far as the most recent type of knitting machines is concerned using arcuate needles, needle beds, needle guides and locks, the use of conventional groove guides which run obliquely with respect to the lock would be very inaccurate and extremely complicated to make.

It is therefore an object of the invention to provide a wing cam guide for knitting machines which do not have the disadvantages of the straight groove guides and which, in particular, is usable for knitting machines with arcuate needles and needle beds, without any limitations.

This object of the invention is obtained by the provision of a wing cam guide for knitting machine locks having a wing cam which is pivotably mounted.

For use of the wing cam guide in knitting machines with arcuate bent needles and needle beds, the wing cam would be mounted on a ball or universal joint mounted on a hinge plate, so as to be pivotable into two planes. As a result, the wing cam would always maintain the same distance with respect to the concavely-shaped upper side of the needle bed during its relative movement on the hinge plate.

Other objects and features of the present invention will become apparent from the following detailed description when taken in connection with the accompanying drawing which discloses one embodiment of the invention. It is to be understood that the drawing is designed for the purpose of illustration only and is not intended as a definition of the limits of the invention.

In the drawing, wherein similar reference characters denote similar elements throughout the several views.

Figures 1, 2, 3, 4:
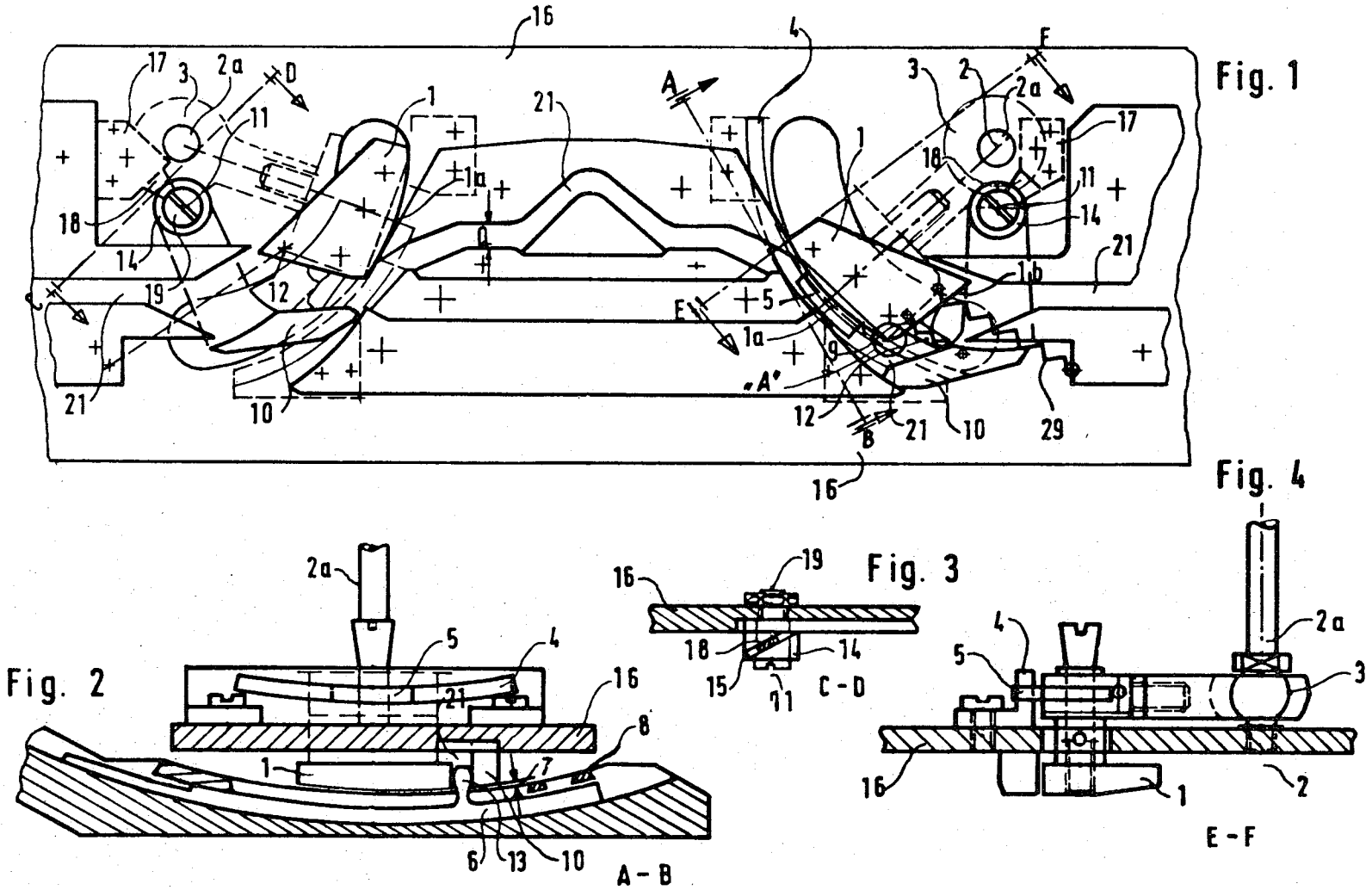
FIG. 1 is a view onto the lower side of the lock with the main locking parts.
FIG. 2 is an oblique sectional view through the needle bed taken along line A-B of FIG. 1.
FIG. 3 is an oblique sectional view taken along line C-D of FIG. 1.
FIG. 4 is an oblique sectional view through the lock taken along line E-F of FIG. 1.

In accordance with FIG. 1, the lock is provided on its hinge or cam plate 16 with the usual parts forming the machine, like drive, catching, triggering or wing cam device 1, bring up, limiting device or the lock bridge, respectively, between which the lock channel or guide channel 21 is formed. In contrast to the usual straight slide guide provided by means of a longitudinal aperture or groove, wing cam 1, in accordance with the subject invention, is pivotably mounted for rotation about axis 2. While the axis of rotation 2 may be a bolt **2*a* for roof slope-like needle beds mounted on the hinge plate, this mount is a ball or universal joint 3 in the embodiment of the described knitting machine with arcuate needles and needle boards or beds permitting a movement of the wing cam 1** in two different planes.

A curve guide 4 mounted on the hinge plate, which has a curve of the type of an elliptical or circular segment, cooperates with a guide tongue 5 on wing cam 1 in such a manner that wing cam 1, in addition to its relative pivotal movement towards the lock, also executes a superimposed rocking or tumbling movement, so that wing cam 1 is always maintained at the same distance 7 with respect to the concave surface 8 of the needle board, as shown in FIG. 2. While a counter guide is very often provided on the wing cam in commonly-known knitting machines which primarily has to catch the empty moving needles which are not subjected to a force by the thread, the counter guide 10 of the subject invention is shaped as a separate structural part and is rotatably mounted around rotatable axis 11. Wing cam 1 is moved, with the assistance of a tension spring 29 mounted on hinge plate 16, in the direction of its largest triggering position (at "A"), which corresponds to the least firmness of the knitted material. In addition, wing cam 1 is also coupled with counter guide 10 by a tension spring 9, so that these two separately movable parts are positively coupled with each other and so that the counter guide follows the movement of the wing cam. A distance piece or spacer 12 mounted between both parts maintains the cross section Q of guide channel 21 for the needle butts or feet 13, in the perpendicular direction to the needle board, constant or uniform, in any given position of the wing cam 1.

The starting or leading edge **1*a* of wing cam 1 has the curvature of a circular segment defined by the radius extending from the axis of rotation 2. Thereby the engaging angle of the needle feet 13 is always the same when leaving the guide channel 21 of the lock bridge. Since the manufacturer has the free choice in dimensioning the pivot radius and in positioning the axis of rotation 2, it is possible to construct the wing cam guide in such a manner that due to the dynamic-mechanical influence of the needle feet 13, a quasi-servo effect is exerted on wing cam 1 which is supported by the effect of the spring force 29. The runoff or trailing edge 1*b* of wing cam 1 which runs in the reversed incline in a straight line, so that its width shortens, relative to the right angular projection, with increasing lowering of the wing cam. This has the essential advantage that the number of needles or needle feet 13, respectively, which are under thread tension is reduced with increased lowering at this edge, whereby the pressure load of the wing cam is reduced as a whole. By choosing the rotating point 2 of the wing cam it is also possible that the pressure forces of the slagging- or drawing-off needles 6 push wing cam 1 against the adjustment plates, so that the required spring forces for forming the meshes are considerably reduced. Since in the machine types using arcuate needle boards a space superimposed curve-like movement of counter guide 10 is required even with the synchronous pivot movement of counter guide 10, an oblique guide is provided between the boss 14 and a stationary lock part 17 which may be formed, for example, by an oblique slot 15 or a groove in boss 14 and a stationary guide wedge 18, as shown in the sectional view of FIG. 3. In this manner, counter guide 10 executes a screw-like movement when following the pivot movement of wing cam 1, thus retaining the required distance 7 from the surface 8** of the needle board.

The sectional view taken along line E-F of FIG. 1 shown in FIG. 4 shows ball joint 3 and wing cam 1 pivoted thereon. Ball joint 3 is mounted on hinge plate 16, and wing cam 1 with its associated guide tongue 5 slides into curve guide 4 mounted on hinge plate 16, so that a space movement of wing cam 1 results from the two superimposed pivot or tumbling movements, respectively, being adjusted to the surface 8 of the needle boards.

Thus, while only one embodiment of the present invention has been shown and described, it will be obvious that many changes and modifications may be made thereunto, without departing from the spirit and scope of the invention.

What is claimed is:

1. A wing cam guide for knitting machines with arcuate needles, needle beds, needle guides and cam assemblies, comprising:

a wing cam pivotably mounted on a universal joint supported on a cam plate for effecting movement thereof in two planes.

2. The guide according to claim 1, wherein said wing cam and said counter guide are each pivotably mounted on bolts which are mounted on said cam plate and, wherein only said wing cam is drivable and said counter guides is coupled therewith by means of a spring force.

3. The guide according to claim 1, wherein said wing cam is spring loaded in the direction of its largest trigger position.

4. The guide according to claim 1, wherein a guide channel is provided for the needle feet and wherein a distance spacer is mounted between said wing cam and said counter guide which maintains the cross section of said guide channel for the needle feet constant in the perpendicular direction to the needle board, in any given position of said wing cam.

5. The guide according to claim 1, wherein said wing cam is guided in a curve guide which runs substantially transversely to the cam at a uniform distance to the concave upper side of the needle bed and normally to its pivot movement.

6. The guide according to claim 1, additionally including a counter guide and mean for pivotably mounting said counter guide in an axially displaceable manner on a bolt of said cam plate in such a way that it executes a screw-like movement during its pivoting.

7. The guide according to claim 6, wherein said pivotably-mounted counter guide has a boss and a stationary locking part and wherein said means for mounting includes an oblique guide formed between said boss, counter guide and stationary locking part.

* * * * *